US007081829B2

(12) United States Patent
Pierson

(10) Patent No.: US 7,081,829 B2
(45) Date of Patent: Jul. 25, 2006

(54) MARS UNIT LAMP DRIVER

(75) Inventor: Martin D. Pierson, Howell, MI (US)

(73) Assignee: Lionel L.L.C., Chesterfield, MI (US)

( * ) Notice: Subject to any disclaimer, the term of this patent is extended or adjusted under 35 U.S.C. 154(b) by 10 days.

(21) Appl. No.: 10/729,089

(22) Filed: Dec. 4, 2003

(65) Prior Publication Data

US 2004/0178736 A1 Sep. 16, 2004

Related U.S. Application Data

(60) Provisional application No. 60/430,893, filed on Dec. 4, 2002.

(51) Int. Cl.
*G08B 5/36* (2006.01)

(52) U.S. Cl. ..... 340/815.47; 340/815.45; 340/815.5; 340/815.3

(58) Field of Classification Search ..... 340/815.4, 340/815.45, 815.47, 815.5, 815.53; 246/4, 246/167 R, 187 A; 40/433, 547; 426/91, 426/103, 104; 446/431
See application file for complete search history.

(56) References Cited

U.S. PATENT DOCUMENTS

| | | | | |
|---|---|---|---|---|
| 4,860,475 | A * | 8/1989 | Levy et al. | 40/547 |
| 5,251,856 | A * | 10/1993 | Young et al. | 246/4 |
| 6,265,984 | B1 * | 7/2001 | Molinaroli | 340/815.4 |
| 6,416,800 | B1 * | 7/2002 | Weber et al. | 426/104 |
| 6,457,681 | B1 | 10/2002 | Wolf et al. | |
| 6,651,365 | B1 * | 11/2003 | Wainwright | 40/452 |
| 6,655,640 | B1 * | 12/2003 | Wolf et al. | 246/167 R |
| 6,758,718 | B1 * | 7/2004 | Morris | 446/431 |
| 2002/0067607 | A1 | 6/2002 | Baranyai | |

* cited by examiner

*Primary Examiner*—Van T. Trieu
(74) *Attorney, Agent, or Firm*—O'Melveny & Myers LLP

(57) ABSTRACT

An apparatus for a model toy train includes a circuit configured to supply an output signal to energize at least one stationary light to simulate a light having movement like a mars unit light display.

21 Claims, 3 Drawing Sheets

MARS UNIT LAMP DRIVER

PRIOR APPLICATIONS

This application claims the benefit of U.S. Provisional Application No. 60/430,893 filed Dec. 4, 2002.

BACKGROUND OF THE INVENTION

1. Field of the Invention

The invention relates driver for one or more lights mounted on a train engine and, more particularly, to a driver capable of simulating behavior of a Mars Unit of a train engine.

2. Description of the Related Art

In addition to its normal headlight, some train engines also have a Mars Unit mounted thereto. The Mars Unit comprises a white, or emergency red, lamp, or light, and the apparatus that causes the light to oscillate. Sometimes, a portable Mars Unit is equipped at the rear of a train. The white light of the Mars Unit can be a bright white; light or a dim white light.

The Mars Unit is used for a variety of purposes. For example, it can be used as a protection light during the day or night to indicate that the train is disabled. As a protection light, it can also be used when the engine is likely to be overtaken by another engine or when the engine is traveling in adverse weather. Oftentimes, a Mars Unit is set to operate automatically when train speed drops below 18 miles per hour (MPH) and during stops, shutting off automatically when train speed goes above 18 MPH.

The Mars Unit can also be used, with or without the oscillating apparatus, as an emergency headlight in the event the headlight of the train engine fails. If the oscillating apparatus of the Mars Unit is disabled, the light can also be used as a focus light, directing attention to possible fallen rock, etc.

The use of a Mars Unit in a model toy train as implemented in an actual train is impractical due to the cost, size and energy required by the oscillating apparatus.

DETAILED DESCRIPTION

Figure 1:
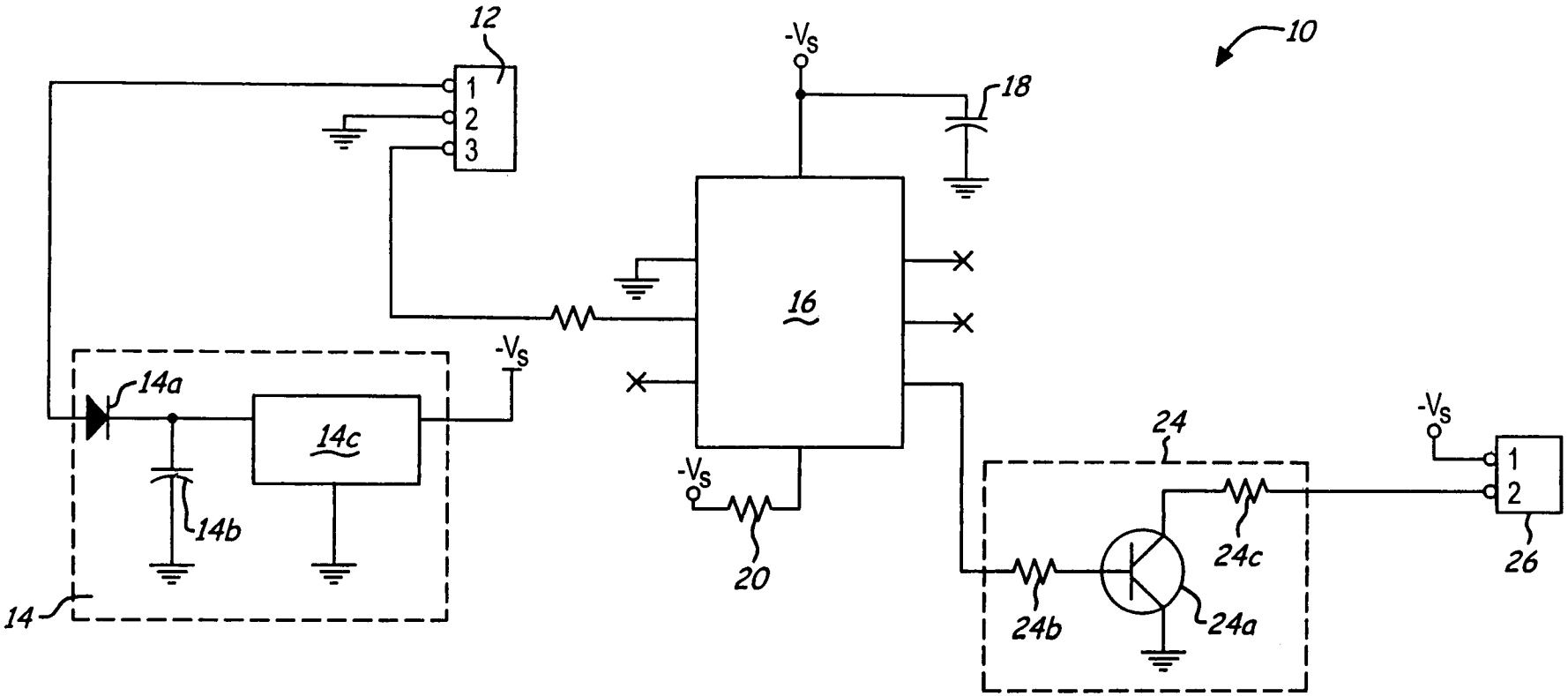
FIG. 1 is a circuit diagram of a lamp driver for one light according to one embodiment of the present invention.
Figure 2:
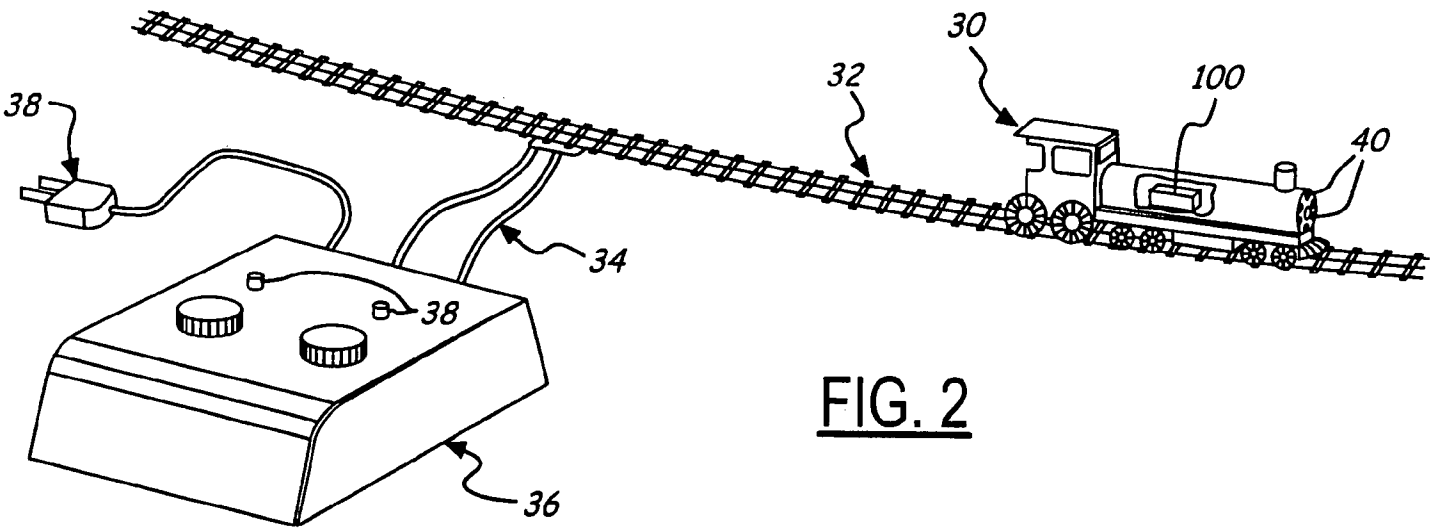
FIG. 2 is a schematic diagram of a partial train set up incorporating a lamp driver for a plurality of lights according to a second embodiment of the present invention.

The present invention is a lamp driver for a model toy train car, particularly a train engine, that can simulate the functionality of a Mars Unit of an actual train without the need for an oscillating apparatus. FIG. 1 shows a simple circuit diagram of one lamp driver 10 than can be used with one or more light-emitting diodes. The lamp driver 10 is mounted on a train car, preferably on a train engine 30 seatingly engaged on a train track 32 as shown in FIG. 2. Although the remainder of the description describes the lamp driver 10 as being mounted on the train engine 30, the lamp driver 10 can, of course, be added to other cars of the train setup. The train engine 30 conventionally receives inputs from the track 32 through a connector, here a three-pin connector 12. For example, where the train engine 30 is equipped to receive serial communications, such as those sent according to Lionel® TrainMaster® command control (TMCC), the three-pin connector 12 supplies both the track voltage from the "third rail" and the serial communications for one or more controllers mounted in the train engine 30. A train engine 30 incorporating a lamp driver 10 that is not equipped for serial communications is discussed in more detail below.

Alternating current (AC) track voltage is fed to a voltage regulator 14, which produces a stable direct current (DC) voltage-Vs. The voltage regulator. 14 is a standard voltage regulator, which typically includes filtering. A diode 14*a* taps the connector 12 at the input of the AC track voltage. The cathode of the diode 14*a* is connected to a grounded capacitor 14*b* and to the input of any standard three-terminal integrated circuit (IC) regulator 14*c*. The output of the regulator 14*c* is a stable DC voltage-Vs. One typical voltage Vs used in these applications is five volts. Therefore, the voltage regulator 14 of FIG. 1 can be a 5-volt voltage regulator.

The DC voltage Vs supplies a processor 16, here a standard eight-pin microcontroller. Of course, a microcontroller is used as the processor 16 by example only. A microprocessor connected to non-volatile memory can also be used as the processor 16. The physical requirements for the processor 16 are best described with reference to its functionality. The processor 16 is supplied by −Vs at its VCC input, which is connected to a grounded filtering capacitor 18. A constant current is supplied to an input of the processor 16 by a resistor 20 connected in series with −Vs. The processor 16 is operable to receive serial communications from the connector 12 through a series resistor 22. The output of the processor 16 is a pulse-width modulated (PWM) signal.

The signal from the processor 16 is fed through a lamp controller 24 prior to being input to one pin of a two-pin connector 26 into which a standard light-emitting diode (LED), or other source of light, can be inserted. The other pin of the two-pin connector 26 is connected to −Vs. The lamp controller 24 performs the function of converting the signal from the processor 16 to a current sufficient to energize the light connected to the two-pin connector 26. In the lamp controller 24 shown in FIG. 1, the output of the processor 16 is connected to base of a standard npn transistor 24*a* through a series resistor 24*b*. The emitter of the transistor 24*a* is grounded, and the collector of the transistor 24*a* is connected to one pin of the connector 26 through a second series resistor 24*c*.

The processor 16 can be programmed according to known methods so that the duty cycle of the PWM signal changes. For example, varying the duty cycle of the signal supplied to an LED from approximately 10% to 90% and then back down to approximately 10% at a predetermined rate, such as once every second, makes the LED resemble an incandescent bulb moving from side-to-side. Using signals from the serial communications, the processor 16 can also be programmed to change the PWM signal output from the processor 16 based upon certain conditions of the train engine 30. Thus, the processor 16 can be remotely controlled using TMCC to operate the light or lights at all times, to operate the light(s) only when the train engine 30 is moving forward, to operate the light(s) only when the train engine 30 is moving in reverse, or to shut off the light(s).

The pulse width modulation signal can be indicative of a signal of varying shape. According to various embodiments, a PWM can be indicative of a saw tooth, triangular, sinusoidal, square, exponential, or other wave form or combination of wave form patterns. Thus the PWM output signal can be used to energize at least one light with varying brightness over time according to the desired pattern. According to one embodiment, the output signal can be supplied to a single light to vary the brightness to simulate a light having movement. According to one embodiment, the output signal can be supplied to a group of lights to energize any one or more within the group with visably varying brightness to simulate a light having movement. According to one embodiment, the output signal can be supplied to sequentially energize a first set of lights followed by a second set of lights wherein the first set includes one or more lights and the second set includes one or more lights to simulate a light having movement. Either the first set or the second set or both can be controlled to include lights having varying brightness to simulate a light having movement.

Many existing and new train cars and engines are unable to respond to serial communications, such as those signals sent using TMCC. FIG. 2 shows a partial train setup where serial communications are not sent, so cannot be received by the train engine 30, even if equipped to receive serial communications. The lamp driver 10 is placed inside the train engine 30. As mentioned, the train engine 30 is seatingly engaged upon the train track 32. The train track 32 is electrically connected, via wires 34, to a user control box 36. The user control box 36 is, in turn, electrically connected to a plug 38, which can be connected to a standard electrical wall socket (not shown). Generally, the user control box 36 converts the AC signal from the wall socket to a lower operating voltage for the train track 32 through the use of a transformer and related circuitry. The user control box 36 may also have buttons 38 that can be pressed to provide a positive or negative DC offset to the AC track voltage to activate a bell or horn (not shown) on the train engine 30. This user control box 36 is merely exemplary; many other means of providing input power to the train track 32 are known in the art. For example, some control boxes known in the art are operable to receive signals from a remote control to control the input power to the train track 32.

In the embodiment of FIG. 2 a plurality of closely-spaced lights 40, LEDs by example, are arranged in a circle surrounding the headlight of the train engine 30. Each of the lights 40 is sequentially energized and de-energized such that the lights 40 simulate the movement of a single Mars lamp of a Mars Unit. The circuit of FIG. 1, of course, can be duplicated so that each of the lights has its own lamp driver 10 controlling a connector 26. However, this is relatively expensive and space-consuming, in addition to requiring more complicated coordination between lamp drivers 10. More desirable is the use of a single lamp driver 100 modified from the lamp driver 10 of FIG. 1. Several modifications to the lamp driver 10 can be incorporated into the lamp driver 100 in order for the lamp driver 100 to control the plurality of lights 40. For example, a multiplexed signal can be sent from the processor 16 to a multiplexer (not shown), and the multiplexer can energize and de-energize each of the lights 40 through a separate lamp controller 24 and connector 26. Alternatively, a processor with a larger number of separately controlled outputs can be used in place of the processor 16. Other possible modifications to the lamp driver 10 are contemplated as being within the level of skill of one in the art. For example, an speed sensor can be connected to an input of the processor 16 such that the output of the processor 16 controls the lights 40 when the train engine 30 falls below a certain speed.

The illustration of FIG. 2 includes a user control box 36 providing only the traditional amplitude-controlled AC voltage and imposed DC offset. However, if any trains cars engaged with the train track 32 are operable to receive and interpret other signals, such as TMCC signals, for example, the user control box 32 can be one that includes such capabilities, or one or more additional boxes can be connected to the train track 32 to provide serial communications. FIG. 2 also highlights another feature of the lamp driver 10/100. The non-volatile memory of the processor 16 can be programmed using serial communications prior to installation in a train, such as train engine 30, to be always on, always off, or to react to a DC offset with the horn or the bell. In this way, the same circuit used with a train engine operable to receive serial communications can also be used in a train engine without such ability. In the production of such items, this flexibility is a definite benefit.

Figure 3A:
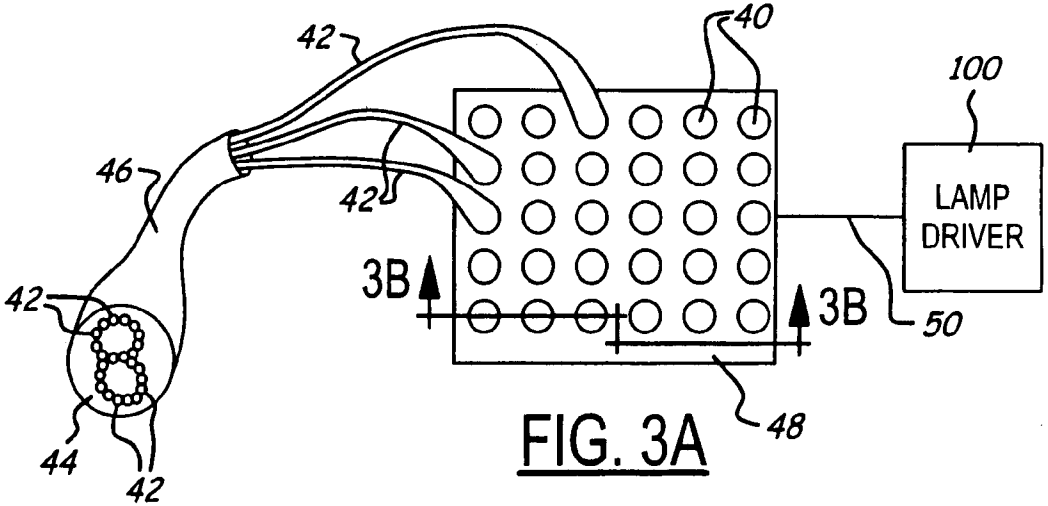
FIG. 3A is a schematic diagram of a fiber optic bundle arranged in a figure eight pattern and connected to a plurality of light-emitting diodes driven by a lamp driver according to the second embodiment of the present invention.
Figure 3B:
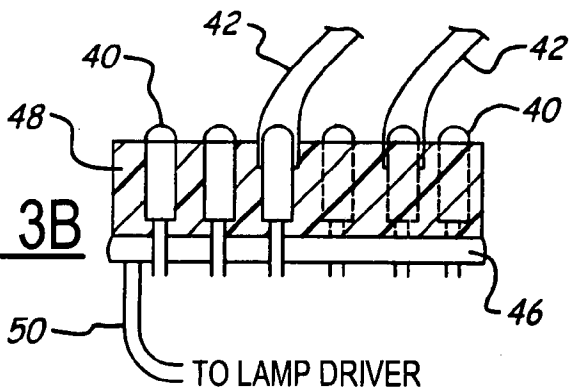
FIG. 3B is a partial cross-sectional view of the circuit board of FIG. 3A.

FIG. 2 shows lights 40, LEDs by example, mounted in the front of the train engine 30. Because of the size of some lights 40 commonly available, this is not a completely satisfactory design. The larger the lights 40, the less likely the optical illusion attempted, that is, the impression that only one lamp is moving from position to position, will be successful. FIGS. 3A and 3B show how a lamp driver 100 controlling multiple lights 40 can be connected to those lights 40 and provide a better optical illusion with currently available components. The lights 40 are LEDs conventionally mounted on a circuit board 46 (not shown in FIG. 3A). Each of the lights 40 is connected to a fiber optic conductor 42, and the fiber optic conductors are arranged in a pattern, such as a figure-eight shown in FIG. 3A. The fiber optic conductors 42 are potted in an epoxy or acrylic 44 and surrounded by a conductor housing 46 from the figure-eight to a point where the fiber optic conductors 42 separate to surround, at least in part, the lights 40. The epoxy or acrylic 44 can be any color such that it blends in with the housing of the train car, such as train engine 30, supporting the figure-eight. Alternatively, smaller lights, small LEDs by example, directly mounted in the front of the model toy car also provide improved optical illusion.

Figure 4:
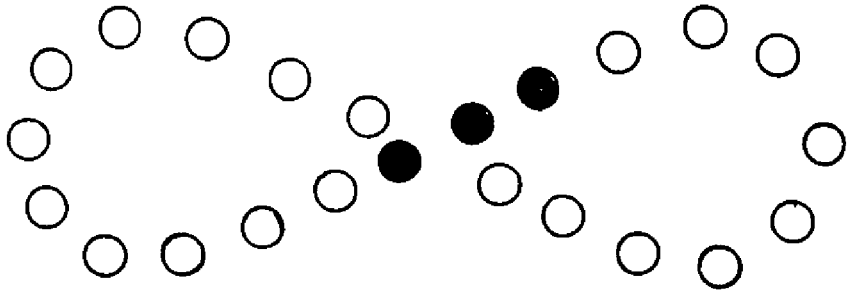
FIG. 4 is a diagram of an embodiment of a fiber optic bundle arranged in a figure-eight pattern with a first set of lights simultaneously illuminated.
Figure 5:
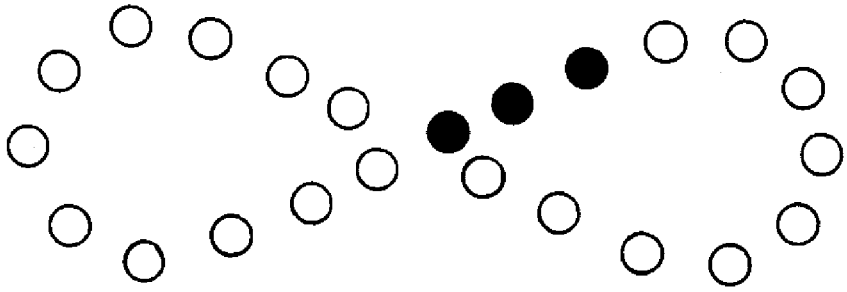
FIG. 5 is a diagram of an embodiment of a fiber optic bundle arranged in a figure-eight pattern with a second set of lights simultaneously illuminated.
Figure 6:
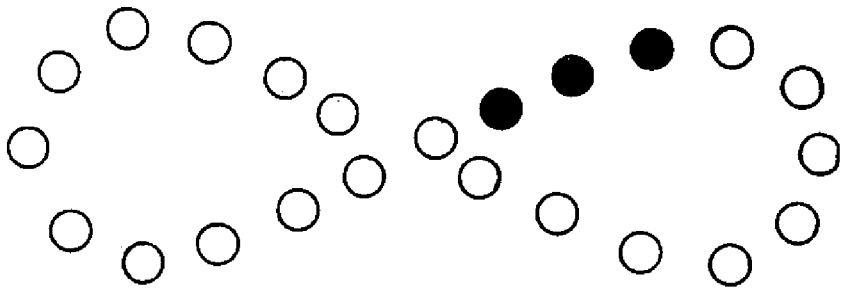
FIG. 6 is a diagram of an embodiment of a fiber optic bundle arranged in a figure-eight pattern with a third set of lights simultaneously illuminated.

The lights 40, with their fiber optic conductors 42, are also potted in an epoxy or acrylic 48. Preferably, although not necessary depending upon the configuration, the epoxy or acrylic 48 is optically-tinted such that light from adjacent lights 40 do not affect the light received at each fiber optic conductor 42. Such an epoxy or acrylic 48 would also provide a sturdy connection for each light 40 and its corresponding fiber optic conductor 42. FIG. 313 shows a partial cross-section of the lights 40 and circuit board 46. The well-known cross-sectional details of LEDs, which are used as the lights 40, have been left out. The circuit board 46 is preferably a printed circuit board with connections from each of the lights 40 to the multi-conductor connector 50 from the lamp driver 100. According to the previous teachings, the lamp driver 100 generates sequential, and, in some cases, slightly overlapping, signals to each of the lights 40 through the connector 50 such that the fiber optic conductors 42 output light that mimics the appearance of one lamp moving in a figure-eight pattern. As shown by the sequence in FIG. 4, FIG. 5 and FIG. 6, groups of 2, 3 or more lights could be activated at a time. The next group of lights to be activated could be adjacent to the first group to be activated, or could overlap the first group. Other patterns are possible, such as the circle described with reference to FIG. 2. Although the description has included the lights 40 as being LEDs, any light is possible keeping in mind the space requirements of the train cars. Another design is possible, for example, using just the chips of the LEDs, without the reflectors and housings, or just with the reflectors.

What is claimed is:

1. An apparatus for a model train operating on a model track to simulate movement of an oscillating light unit, comprising:

a lamp display having at least one stationary light;

a circuitry configured to energize the at least one stationary light and having a processor that comprises:

an input for receiving a first signal; and an output for supplying a processor output signal that is indicative of the first signal; and at least one lamp controller that is in electrical communication with the processor and the lamp display, and receives the processor output signal and converts the processor output signal into a controller output signal to energize the at least one stationary light intermittently to simulate the movement of the oscillating light unit without requiring actual movement of the lamp display.

2. The apparatus of claim 1 wherein the first signal comprises a serial communication signal.

3. The apparatus of claim 1, wherein the first signal provides an instruction to the circuitry selected from the group consisting of: turn on, turn off, and react to DC offset.

4. The apparatus of claim 1, wherein the circuitry output signal being provided as a pulse width modulation signal.

5. The apparatus of claim 1, wherein the first signal is indicative of an operating condition of the model toy train car.

6. The apparatus of claim 5, wherein the operating condition of the model train is selected from the group consisting of: forward direction, reverse direction, speed, and neutral.

7. The apparatus of claim 1, further comprising a connector having a first pin that is in electrical communication with the input of the processor to provide the first signal during operation of the model train.

8. The apparatus of claim 7, further comprising a user control box that is in electrical communication with the connector and converts an AC signal to supply a voltage signal to the model track and the connector, the connector having a second pin for transmitting the voltage signal to the circuitry.

9. The apparatus of claim 8, wherein the user control box converts the AC signal to supply a DC offset to the voltage signal in response to a user input.

10. The apparatus of claim 9, wherein the user control box includes a user input device selected from the group consisting of: (a) a button on the control box for receiving user input, and (b) a remote control for receiving the user input and transmitting the input to the control box.

11. The apparatus of claim 1, wherein:

a serial communication signal is pre-programmed into the processor; and the processor output signal is indicative of the serial communication signal.

12. The apparatus of claim 1, wherein the controller output signal energizes the at least one stationary light intermittently with varying brightness.

13. The apparatus of claim 12, further comprising a fiber optic conductor having a base connected to the at least one stationary light and an end that emits light from the at least one stationary light with visibly varying brightness.

14. The apparatus of claim 1, wherein the controller output signal sequentially energizes at least intermittently a first set of lights and a second set of lights to simulate light movement, wherein the first set includes one or more stationary lights and the second set includes one or more stationary lights.

15. The apparatus of claim 14, wherein the controller output signal energizes at least one light with visibly varying brightness to simulate moving light.

16. The apparatus of claim 14, wherein the second set includes at least one light adjacent the first set of lights.

17. The apparatus of claim 14, wherein the second set further includes at least one light included in the first set.

18. The apparatus of claim 14, wherein the controller output signal is sufficient to energize at least one of the lights in the first and second sets.

19. The apparatus of claim 18, wherein:

the lamp display includes a plurality of stationary lights each in electrical communication to receive the controller output signal; and the controller output signal sequentially energizes the first set of stationary lights and the second set of stationary lights to simulate moving light.

20. The apparatus of claim 19, wherein the stationary lights are fixedly mounted in a pattern selected from the group consisting of: a circle configuration, and a figure-eight configuration.

21. The apparatus of claim 19, further comprising a fiber optic conductor corresponding to an individual light of the stationary lights, the fiber optic conductor having a base connected to the individual light and an end that visibly emits light with varying brightness to simulate moving light.

* * * * *